United States Patent [19]

Biermann et al.

[11] Patent Number: 4,672,356

[45] Date of Patent: Jun. 9, 1987

[54] POTENTIOMETER CHAMBER ON THE INTAKE PIPE OF AN INTERNAL COMBUSTION ENGINE

[75] Inventors: Eberhard Biermann, Uhldingen; Erwin Nägele, Hessigheim; Peter Romann, Stuttgart, all of Fed. Rep. of Germany

[73] Assignee: Robert Bosch GmbH, Stuttgart, Fed. Rep. of Germany

[21] Appl. No.: 713,055

[22] Filed: Mar. 18, 1985

[30] Foreign Application Priority Data

Jul. 26, 1984 [DE] Fed. Rep. of Germany ..... 8422232

[51] Int. Cl.[4] ..... H01C 1/02

[52] U.S. Cl. ..... 338/184; 123/494; 338/199

[58] Field of Search ..... 123/494; 338/184, 199

[56] References Cited

U.S. PATENT DOCUMENTS 3,824,966 7/1974 Schneider et al. ..... 123/494

3,880,125 4/1975 Kammerer et al. ..... 123/494

*Primary Examiner*—E. A. Goldberg

*Assistant Examiner*—M. M. Lateef

*Attorney, Agent, or Firm*—Edwin E. Greigg

[57] ABSTRACT

A potentiometer chamber on the intake pipe wall of an internal combustion engine for containing an electrical potentiometer. The potentiometer chamber comprises a limiting wall, formed by the intake pipe wall, a sidewall extends thereto from which serves as lateral limits of the chamber. A partition made by injection molding from plastic, into which are embedded electrical contacts extends from the sidewall and a lid is placed on the partition. Therefore the limiting wall, the sidewall, the partition, and the lid form the chamber that encloses a potentiometer.

6 Claims, 2 Drawing Figures

POTENTIOMETER CHAMBER ON THE INTAKE PIPE OF AN INTERNAL COMBUSTION ENGINE

BACKGROUND OF THE INVENTION

The improvement is based on a potentiometer chamber on the intake pipe of an internal combustion engine. A potentiometer chamber is already known (German Pat. No. 22 02 866), in which the compact construction has resulted in a complicated assembly procedure.

OBJECT AND SUMMARY OF THE INVENTION

In contrast to the foregoing, the potentiometer chamber in accordance with the present invention has the advantage of offering a simple and rational construction, which makes possible a simplified assembly.

By means of the steps recited herein, advantageous improvement and advances of the potentiometer chamber recited become possible. It is especially advantageous to dispose on the partition electrical connecting contacts and at least one electrical plug.

The invention will be better understood and further objects and advantages thereof will become more apparent from the ensuing detailed description of a preferred embodiment taken in conjunction with the drawings.

BRIEF DESCRIPTION OF THE DRAWINGS

An exemplary embodiment of the improvements is shown in simplified form in the drawings and is further explained in the ensuing description.

DESCRIPTION OF THE PREFERRED EMBODIMENT

Figure 1:
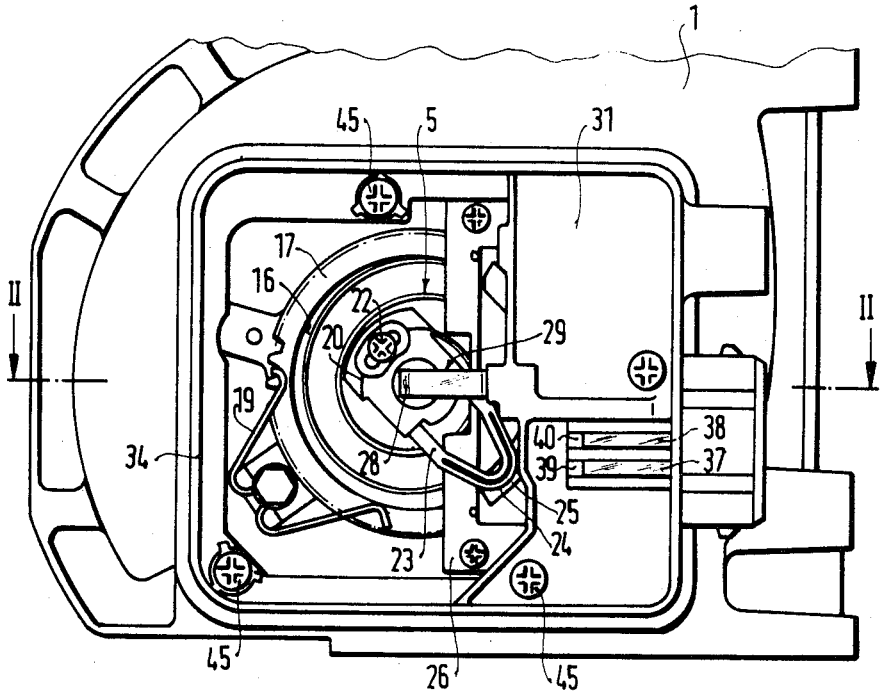
FIG. 1 is a top view of a potentiometer chamber in accordance with the present invention without a lid.
Figure 2:
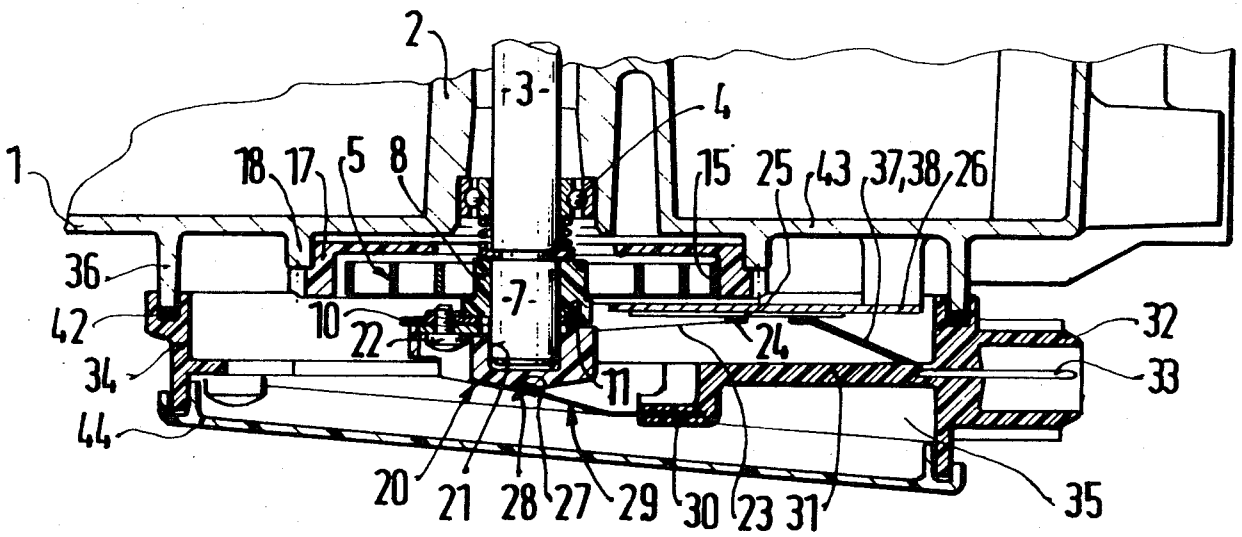
FIG. 2 is a section along the line II—II of FIG. 1.

FIGS. 1 and 2 show an electrical potentiometer which could be installed on the wall 1 of an intake pipe of an internal combustion engine, for instance. A collar 2 is connected with the intake pipe wall 1, and extends to the inside thereof which may support a bearing shaft 3 by means of a roller bearing 4 in a rotatable manner. The bearing shaft 3 extends cross-wise to the direction of flow of the air taken in by the intake pipe and supports in a known manner an air metering device, for instance in the form of a baffle, which is fixed to the bearing shaft and turns the bearing shaft against the force of a return spring 5, disposed as a helical spring, to a larger or smaller degree, depending on the flow of the air mass. A support body 8, extruded from plastic, is placed on the bearing shaft end 7 extending from the intake pipe, and a metal fastening sheet 10 with at least one angled tongue 11 is disposed thereon. The inner end of the helical spring 5 is also fastened on the support body 8, while the outer end 15 is fastened on the wall of a recess 16 of a disk 17, the position of which can be fixed, for instance by a holding spring 19, in an annular section 18 of the intake pipe wall. A support body 20 made from plastic and having a blind bore opening 21 has also been placed on the bearing shaft end 7 and is fastened by means of a screw 22 to the fastening sheet 10, so that the support body 20 follows every move of the bearing shaft 3. One end of a wiper 23 is injected into the support body 20, the contact end 24 of which can wipe along a circular resistance path 25 of the potentiometer placed on a mounting plate 26. A contact 27 is connected in an electrically conducting manner with the wiper 23, said contact is fixedly disposed on the support body 20 in the extension of the pivot axis of the bearing shaft 3. The free end 28 of a leaf spring 29 touches the electrical contact 27, said leaf spring is fixed with its other end to a connecting contact 30. The force of pressure of the leaf spring 29 against the contact 27 is easy to adjust and check.

The connecting contact 30 is partially injected with its end away from the leaf spring 29 into a support wall 31 formed by injection molding from plastic and is connected in an electrically conducting manner with a contact prong 33 of a flat plug 32, which is disposed as a part of a partition 34, formed by injection molding from plastic, on the outside of said partition 34, while the support wall 31 is also part of the partition 34 and extends towards the inside. The continuous partition 34, having no openings, is a part of the lateral limits of the potentiometer chamber 35, the other part of the lateral limits being a sidewall 36, connected with the intake pipe wall 1 and extending therefrom by an angle, for instance 90°, also being continuous and having no openings. Further connecting contacts 37, 38 are connected in an electrically conducting manner with further contact prongs of the flat plug 32, which are also partially embedded in the plastic part 34 made by injection molding. When placing the partition 34 on the sidewall 36, the connecting contacts 30, 37, 38 assume their working positions, in which the connecting contact 30, together with the leaf spring 29, touches the contact 27 under tension and the connecting contacts 37, 38 touch the contact points 39, 40 of the resistance path 25.

A seal, for instance an O-ring, is disposed between the sidewall 36 and the partition 34. Running parallel to the intake pipe wall 1, the potentiometer chamber 35 is limited by a limiting wall 43 as part of the intake pipe wall. A lid 44 has been placed on the partition 34 facing away from the limiting wall 43, closing the potentiometer chamber 35 on this side, and which can be glued together with the partition 34. Screws 45 lead from the partition 34 to the intake pipe wall 1 and produce a tension on the partition 34 in the direction of the sidewall 36.

Based on the development of the potentiometer chamber 35 in accordance with the present invention, a simpler assembly of the potentiometer and the potentiometer meter chamber is possible, especially in case of fully automatic asembly, which results in lower costs.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A potentiometer chamber located on a wall of an intake pipe of an internal combustion engine, comprising a limiting wall formed by the wall of the intake pipe, a sidewall extending from said limiting wall at an angle and forming a continuous lateral limit, and a lid, said chamber comprising a partition which extends outwardly from said sidewall between the sidewall and the lid with the lid mounted upon said partition.

2. A potentiometer chamber in accordance with claim 1, characterized in that said partition is made of plastic.

3. A potentiometer chamber in accordance with claim 2, characterized in that a seal is disposed beween said sidewall and the partition.

4. A potentiometer chamber in accordance with claim 2, characterized in that at least one electrical plug and electrical connecting contacts are disposed on the partition.

5. A potentiometer chamber as set forth in claim 1, in which said partition includes a support wall which extends towards the inside of said chamber.

6. A potentiometer chamber as set forth in claim 4, in which said partition includes a support wall which extends towards the inside of said chamber and said electrical connecting contacts are disposed on said support wall.

* * * * *